US007229182B2

(12) United States Patent
Schrader et al.

(10) Patent No.: US 7,229,182 B2
(45) Date of Patent: Jun. 12, 2007

(54) LIGHTED HOOP

(76) Inventors: Darren E Schrader, 13447 NE. Couch St., Portland, OR (US) 97230; Donald G Rischitelli, 4024 SW. 45th , Portland, OR (US) 97221

( * ) Notice: Subject to any disclaimer, the term of this patent is extended or adjusted under 35 U.S.C. 154(b) by 39 days.

(21) Appl. No.: 11/124,683

(22) Filed: May 9, 2005

(65) Prior Publication Data

US 2006/0250797 A1 Nov. 9, 2006

(51) Int. Cl.
*F21V 33/00* (2006.01)

(52) U.S. Cl. ..... 362/108; 362/249; 362/252; 362/234; 446/236; 446/242

(58) Field of Classification Search ..... 362/235–237, 362/249, 251, 252, 108, 234, 806; 446/242, 446/219, 28, 236
See application file for complete search history.

(56) References Cited

U.S. PATENT DOCUMENTS 989,944 A * 4/1911 Bramson ..... 362/184
3,509,660 A 5/1970 Seymour
3,755,663 A * 8/1973 George, Jr. ..... 362/249
3,911,264 A 10/1975 Chao
4,006,556 A 2/1977 Williams
4,052,982 A 10/1977 Ozeryansky
4,085,541 A * 4/1978 Mapp ..... 446/450
4,480,831 A 11/1984 Muller-Deinhardt
4,800,469 A 1/1989 Leon
4,812,956 A * 3/1989 Chen ..... 362/249
4,847,735 A 7/1989 Kawasaki
4,915,666 A 4/1990 Maleyko
5,083,964 A 1/1992 Arad et al.
5,108,340 A * 4/1992 Farrow ..... 446/242
5,145,443 A 9/1992 Vaisnys et al.
5,484,316 A 1/1996 Poirier
5,934,792 A * 8/1999 Camarota ..... 362/249
6,036,573 A 3/2000 Huang
6,217,194 B1 * 4/2001 Huang ..... 362/249
6,467,939 B2 10/2002 Deutsch et al.
6,491,516 B1 * 12/2002 Tal et al. ..... 431/253
6,582,329 B1 * 6/2003 Cabrera ..... 473/480
2005/0255787 A1 * 11/2005 Pak ..... 446/236

* cited by examiner

*Primary Examiner*—Thomas M. Sember
(74) *Attorney, Agent, or Firm*—Ipsolon LLP

(57) ABSTRACT

A toroidally shaped hoop such as a hula hoop or juggling ring has a plurality of independently powered and motion-activated lights spaced around a periphery of the hoop. Rotation of the hoop causes the lights to energize and illuminate.

10 Claims, 1 Drawing Sheet

LIGHTED HOOP

TECHNICAL FIELD

This invention relates to toys and novelty items, and more particularly to a hoop toy having a plurality of independently powered and motion-activated lights spaced around a periphery of the hoop.

BACKGROUND OF THE INVENTION

Hoop toys such as those commonly called "HULA HOOPs" are very common and there are many, many different types of such toys. Most often these devices are used as a fun activity in different kinds of games. Just the same, HULA HOOPs are also often used as exercise devices.

HULA HOOPs may be fabricated from a variety of different materials, but usually are constructed of a plastic tube formed into a circle. The hoop is placed around the users hips, which are then moved in a motion reminiscent of a hula dancer, causing the hoop to rotate around the user's hips.

There are many variations on the basic HULA HOOP just described, including many patents directed toward hoop innovations. Among the many patents on hoop toys are several patents that disclose hoops having lighting systems incorporated into the hoops, including U.S. Pat. Nos. 4,006,556 (Illuminated HULA HOOP), 4,915,666 (Lighted Hoop), and 5,108,340 (Musical and Lighted Entertainment and Exercise Device). In each of these patents a battery-powered lighting system is incorporated into the hoop as an added measure of making the hoop more fun and interesting. However, the lighting systems incorporated into the hoops described in each of these patents are relatively complicated, relying upon batteries, switches, and interconnecting wiring systems, making use of the systems somewhat unwieldy, difficult to manufacture and expensive for a product that is primarily a toy and novelty item.

There is a need therefore for improved lighting systems for hoop toys.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF ILLUSTRATED EMBODIMENTS

Figure 1:
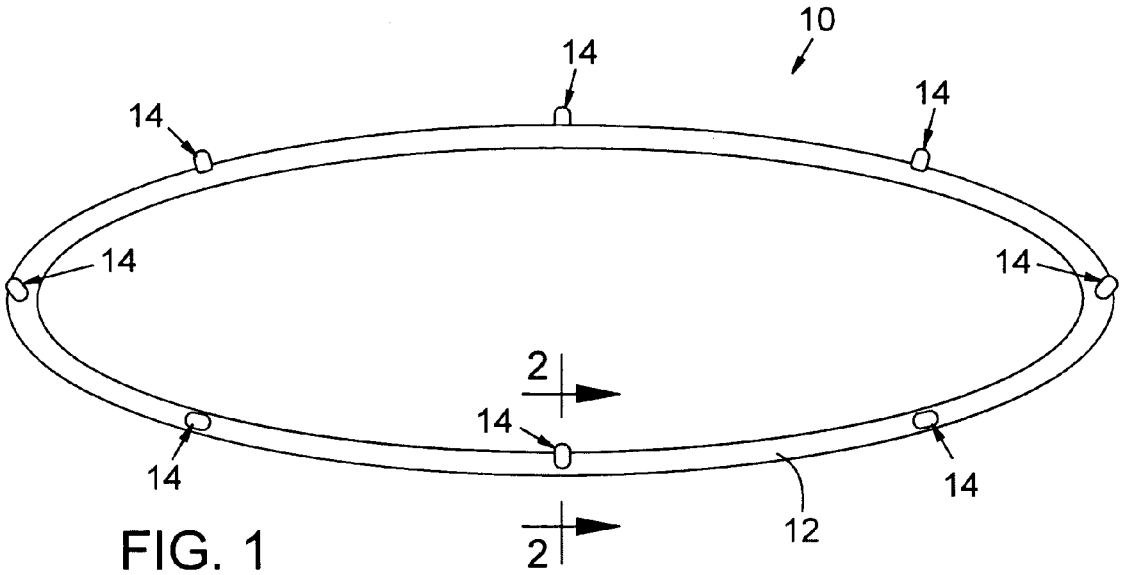
FIG. 1 is a perspective view of a hoop according to the present invention showing a plurality of lights spaced around the hoop.

With reference to the figures, a hoop 10 according to the present invention is defined by a tubular member 12 formed into a circular shape that may be described as an ordinary or "ring" torus. As described below, the tubular member shown in the drawing figures is of a size adapted to be used as a HULA HOOP-typically the hoop 10 has a diameter large enough to be fit over a user's hips. However, the invention as defined in the claims is not limited to a hoop designed to be used as a HULA HOOP, but also envisions hoops of other sizes such as relatively smaller hoops that are useful for juggling and other games.

Tubular member 12 is preferably fabricated from a plastic material that is extruded or otherwise formed. Typically, opposite ends of a sufficient length of the tubular material are joined to form the torus shaped hoop 10. The tubular member 12 may be any color or combination of colors, and may be translucent, transparent or opaque. Often, the member has fanciful colors and designs formed on the exterior surface. The interior of tubular member 12 is preferably hollow, but may be solid or filled with other materials.

A plurality of lights 14, also referred to as light fixtures 14, are spaced around the tubular member 12. As detailed below, each light 14 is a self-contained, motion activated light that includes a power source, a motion-activated switch, and an illumination source such as a light emitting diode (LED). Because each light 14 is self-contained and includes its own power source, there is no need for wiring systems for interconnecting separate lights with a common power source. Thus, each light fixture 14 is capable of full operation independent of any other light fixture 14. This greatly simplifies manufacturing and maintenance of hoop 10.

Figure 2:
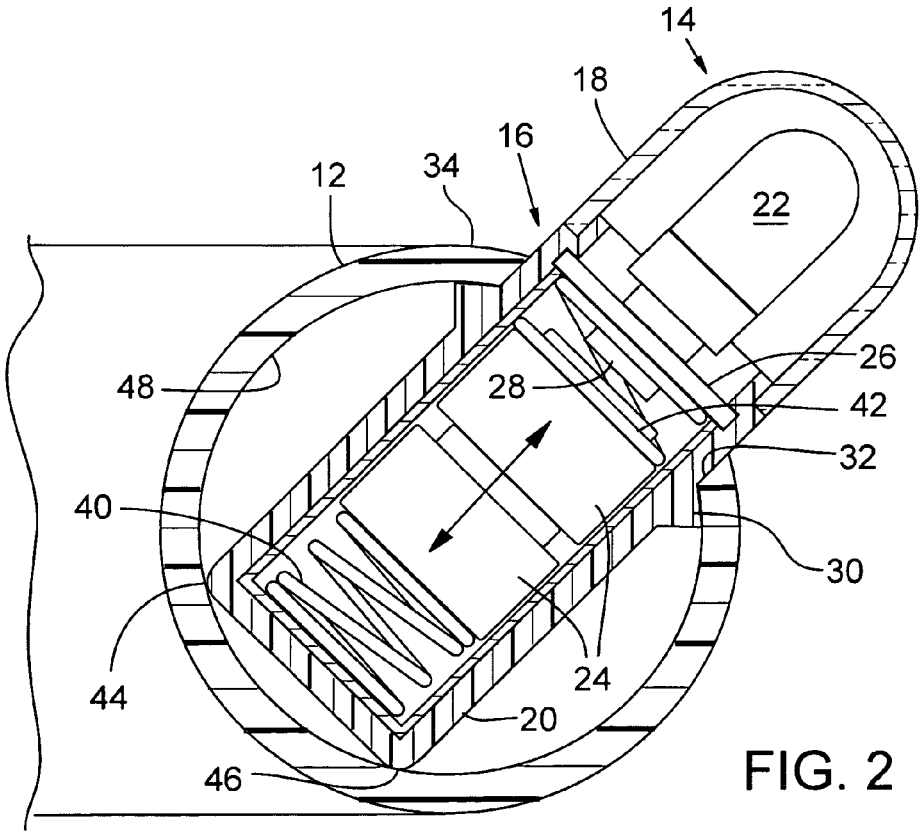
FIG. 2 is a cross sectional view taken along the line 2-2 of FIG. 1 and showing one light in the hoop in partial cross section.

With reference to FIG. 2, a single light 14 is shown in isolation and partial cross section with the light fixture in place in the tubular member 12. Light 14 preferably includes a housing 16 defined by a lens 18 and a lower housing member 20. The lens 18 is clear or translucent, preferably plastic, and may be colored, and is removably attached to lower housing 20 with a snap-on press fit, or with threads and the like so that the lens may be easily removed from the lower housing—for example to replace batteries—and replaced thereon. The lens 18 may be omitted and is thus considered to be optional.

Lower housing 18 is preferably fabricated from metal, but may be plastic as well. Lower housing 18 serves as a container for retaining the power source for light 14, which is shown as two batteries 24, which as noted may be replaced when power is depleted therefrom, and the electrical components of the light. Light 14 includes a light source 22, which preferably is a LED, which may be colored or white, and control electronics including a motion-activated switch mechanism shown generally at 28 and a circuit board shown generally at 26. In some instances, multiple light sources 22 may be incorporated into a single light 14, and the electronics in the light may facilitate random flashing of the multiple lights. Such multiple light sources may be of different colors.

Switch mechanism 28 is activated by motion of light 14 so that when the light 14 moves, the electrical circuit that powers light source 22 is closed and the light source is thereby illuminated. The switch mechanism is preferably a spring-biased mechanism such as shown in FIG. 2 wherein a first spring 40 on one side of batteries 24 and a second spring 42 maintains the batteries in a position between the electrical contacts, so the circuit is open and the light source 22 is not energized. It will be appreciated that in the context of hoop 10 and its normal movement in a circular motion, centripetal force is the primary type of force that causes switch mechanism 28 to close the electrical circuit. Thus, as the hoop 10 rotates around an axis transverse to the plane defined by the hoop, centripetal force urges the batteries outwardly in the direction of the arrow in FIG. 2, against the biasing force of spring 42 but under the urging force of spring 40. When the battery pole makes electrical contact with an associated electrical contact on the circuit board 26, the light source 22 is energized and illuminated. When rotational or other motion of hoop 10 stops, the electrical circuit is opened and the light turns off.

The motion-activated switch just described is only one of many other motion-activated switch mechanisms that will suffice for use with the present invention.

As noted, the control electronics may include circuit board 26, which may optionally include flasher circuitry so that the light 14 is illuminated in an on/off fashion so long as the circuit is closed. Alternately, the light source 22 may be turned off immediately upon opening of the circuit when motion of light 14 ceases.

A circumferential tab 30 is formed on the outer surface of lower housing 20 near the junction of the lower housing with lens 18. With reference to FIG. 2, a plurality of openings 32 are formed in tubular member 12 for receiving a plurality of lights 14. Each opening 32 is sized to snuggly but removably receive the lower housing portion of light 14, but the opening is smaller than the dimensions of light 14 at the outermost portion of the tab 30. A light 14 is inserted into an opening 32 until the tab 30 slips past the wall 34 of tubular material 12. The tab 30 thus prevents light 14 from inadvertently being removed from opening 32, for example, by centripetal force applied to the light as the hoop spins. Nonetheless, the light 14 may be removed for maintenance, battery replacement, by pulling the light out of the opening. Alternately, light 14 may be held in opening 32 by a friction fit, or by a threaded opening and the like. In the illustrated embodiment, the light 14 is sized so that the end portions 44, 46 of lower housing 20 make contact with the inner wall 48 of tubular material 12 when tab 30 is in position in opening 32. The lowermost end of lower housing 20 may be formed in the shape of a dome to conform to the curved inner wall 48 if desired.

A motion-activated, self-contained light fixture having control electronics, switch mechanisms and power sources, and a general configuration suitable for use in accordance with the present invention is described in detail in U.S. Pat. No. 6,467,939, which is incorporated herein by this reference. The light disclosed in the '939 patent incorporates means for attaching the light to an inflation valve of a wheel, but because such components are of no need in the present invention, the base of the light may be modified accordingly for use herein.

The size of hoop 10 and the number of lights 14 used with any particular hoop may vary according to any number of factors. If more than one light 14 is used, the plural lights 14 are preferably evenly spaced at regular intervals around the length of tubular member 12 so that the hoop is rotationally balanced. On the other hand, the lights may be placed in irregularly spaced positions where their weight distribution intentionally causes rotational wobble to add an extra measure of challenge to use of the hoop. The hoop may be of a typical size for use as a "HULA HOOP" or may be of a smaller diameter appropriate for use of the hoop as a juggling hoop. The hoop 10 shown in FIG. 1 uses 8 lights 14 spaced at regular intervals around the circumference of the hoop. However, a greater or fewer number of lights may be used. A hoop may include more openings 32 than lights 14. That is, it is not necessary to fill each opening with a light.

Openings 32 may be formed in tube member 12 so that lights 14 protrude outwardly from the tube member at any desired angle relative to the plane defined by the tube. Thus, with reference to FIG. 2, opening 32 is formed so that the light 14 is held at about a 45° angle relative to the plane defined by the tube member. This angle may be varied in any desired manner. For example, the openings may be formed so that light 14 is held transverse to the tube plane, parallel to the tube plane, or above or below the tube plane. Moreover, within a tube the angle of one light relative to the tube plane may be varied relative to adjacent lights, and so forth. Preferably, the lights 14 protrude from an outer circumference of the hoop 10, leaving the inner circumference unobstructed so that in use the lights do not contact the user's hips during HULA HOOP activity, or otherwise interfere with the normal use of the hoop. Alternately, the light 14 may be fabricated so that the lens is flush with the outer surface of wall 34, leaving both the outer and the inner circumferences unobstructed.

Hoop 10 according to the present invention is relatively easy to manufacture because it needs no internal wiring, batteries, or other electrical connections. Openings 32 may be formed during manufacture of the hoop or may be formed later by drilling, or by punching. In use, each of the lights 14 is illuminated independently of the other lights by action of the motion-activated switching mechanism described above. The lights 14 continue to illuminate for so long as the hoop 10 is in motion, or if motion has stopped, when the power circuit is opened.

It will be appreciated that various modifications may be made to the invention claimed herein. For example, openings 32 may be formed to extend completely through both opposite sides of wall 34 of tubular member 12. In this case, the lights 14 may be somewhat longer so that the "inner" end of the light extends completely through the tubular member. The light may then be held in place in the tubular member with a cap that fits over the "inner" end of the light where it protrudes through the wall 34.

As another alternate, one or more of the lights 14 may be replaced by plugs having a different weight from the lights in order to give the tubular member 12 a different rotational characteristic. The plugs may be provided with differing weight, as well. Such plugs would have the same outer surface geometry so that the plugs would fit snuggly into openings 32 and remain in place during use.

Finally, it will be appreciated that chemoluminescent illuminators may be used as the "plugs" just described. Such illuminators are commercially available from numerous sources. Generally described, the light sticks are hollow, pliable plastic rods. Sealed inside the rods are two or more liquids. At least one of the liquids is further sealed in a breakable ampule or ampules (such as glass) that keeps the liquids separated until illumination is desired. Bending the rod breaks the internally contained ampule allowing the previously separated liquids to intermix. When the liquids mix, a chemical reaction is initiated that releases light. An observer can see the light that passes through the plastic rod. The color of the perceived light from the chemoluminescent sticks may be varied by inclusion of various chemicals in the liquids. It will be understood therefore that the term light fixture as used herein includes not only the electrical lights described above, but also chemoluminescent illuminators since these also eliminate the necessity for complicated wiring, bulb and battery systems.

Having here described illustrated embodiments of the invention, is anticipated that other modifications may be made thereto the scope of the invention by those of ordinary skill in the art. It will thus be appreciated and understood that the spirit and scope of the invention is not limited to those embodiments, but extend to the various modifications and equivalents as defined in the appended claims.

We claim:

1. A hoop toy, comprising:

a hoop body;

at least one opening in the hoop body extending from an outer circumference of the body into the interior of the hoop body, said at least one opening having a circumference;

a light configured for insertion into the opening, said light comprising a housing, a light source in the housing, an electrical circuit sufficient to provide an electrical connection for the light source, a power source in the housing and a motion-activated switch operable to close the electrical circuit in response to movement of the light, and to open the electrical circuit when movement of the light stops, wherein said light further comprises a spring contained in the housing for maintaining the power source in a first position in which the electrical circuit is open when the hoop is not moving, and when said hoop is moved circumferentially said spring is biased by centripetal force such that the power source closes the electrical circuit to illuminate the light source; and said housing including a tab extending around an outer periphery of the housing, said tab defining a circumference greater than the circumference of the at least one opening, whereby when said housing is inserted into said opening, said tab rests adjacent an inner wall of said hoop body and prevents removal of said light when said hoop is moved circumferentially.

2. The hoop toy according to claim 1 including plural openings in the hoop body spaced apart at regular intervals along the length of the hoop, and plural lights, each of said lights configured for insertion into an opening and each of said lights comprising a light source, a power source, an electrical circuit sufficient to provide an electrical connection for the light source, and a motion-activated switch operable to close the electrical circuit in response to movement of the light, and to open the electrical circuit when movement of the light stops.

3. The hoop toy according to claim 1 wherein the hoop body further comprises a hollow member.

4. The hoop toy according to claim 3 wherein each light comprises a housing and the housing includes a lens and a lower housing member, and wherein when the light is inserted into the opening, the lens remains exteriorly of the hoop body.

5. The hoop toy according to claim 1 including control circuitry in each light for illuminating each light in an on/off flashing manner.

6. The hoop toy according to claim 1 wherein the light source is a LED.

7. The hoop toy according to claim 1 including retaining means for holding the light in the opening against centripetal force applied to the light when the hoop body is moved circumferentially.

8. A hoop toy, comprising:

a torus shaped body having an exterior wall and a hollow interior;

plural openings in an outer circumference of the exterior body wall;

plural light fixtures, one light fixture received in each opening, each light fixture comprising a cylindrical housing having an outer diameter sized to be received in one of the plural openings, said housing further having a outer surface with a peripheral tab formed thereon, the peripheral tab defining a diameter greater than the diameters of the plural openings, wherein when a housing is received into an opening, said peripheral tab is retained in the hollow interior of the body, a power source within the housing, a light source, an electrical circuit sufficient to provide an electrical connection between the power source and the light source, and a switch responsive to movement of the body to close the electrical circuit to energize the light, said switch defined by a first spring in the housing on one side of the power source separating the power source from the switch, and a second spring in the housing on the opposite side of the power source, the first spring being compressible by movement of the body such that the power source makes electrical contact with the switch.

9. The hoop toy according to claim 8 wherein each light fixture includes electronic control circuitry so that the light source is energized alternately when the electrical circuit is closed to cause the light source to flash on and off.

10. The hoop toy according to claim 9 wherein the power source comprises a battery.

* * * * *